US006010299A

United States Patent [19]

Jesswein

[11] Patent Number: 6,010,299

[45] Date of Patent: Jan. 4, 2000

[54] LIFTING AND POSITIONING DEVICE

[76] Inventor: Ronald M. Jesswein, 95 Brookfield Ln., Hendersonville, N.C. 28739

[21] Appl. No.: 09/074,908

[22] Filed: May 8, 1998

[51] Int. Cl.[7] ..... E04G 21/16

[52] U.S. Cl. ..... 414/743; 254/8 R; 414/11; 414/917; 269/904

[58] Field of Search ..... 254/8 R, 93 H; 414/11, 743, 917; 269/58, 59, 904

[56] References Cited

U.S. PATENT DOCUMENTS

| | | | |
|---|---|---|---|
| 2,789,869 | 4/1957 | Hammagren | 304/29 |
| 2,939,590 | 6/1960 | Henry . | |
| 3,111,232 | 11/1963 | Benson | 414/11 |
| 3,822,023 | 7/1974 | Cordel . | |
| 4,175,899 | 11/1979 | Tipton | 414/11 |
| 4,449,879 | 5/1984 | Mercer | 414/11 |
| 4,482,130 | 11/1984 | Paredes | 414/11 X |
| 5,322,403 | 6/1994 | Herde | 414/11 |
| 5,375,963 | 12/1994 | Wohlwend | 414/685 |

*Primary Examiner*—Janice L. Krizek
*Attorney, Agent, or Firm*—Joseph T. Guy, Jr.

[57] ABSTRACT

A device for lifting and positioning building materials at different heights and angles. For example, positioning a sheet of drywall or plywood to be fastened to a ceiling or wall, or subsequently a container of materials such as drywall joint compound for finishing the fastened sheets. The lifting and positioning device comprises a platform assembly upon which to place material to be lifted and positioned. The platform assembly can be pivoted and fixed at any desired angle between horizontal and vertical (0 to 90 degrees) by an indexing arrangement. The platform assembly is pivotally connected to lift arm links. The lift arm links are pivotally connected to a lift arm assembly. The lift arm assembly is pivotally connected to a mast support assembly. The lift arm links, lift arm assembly and mast support assembly form a parallelogram. The platform assembly is raised and lowered by a floor jack placed upon a jack support platform. As the floor jack is actuated, the jack saddle moves upward, pushing on a push link connected to the lift arm assembly causing the platform assembly to raise. Because of the parallelogram arrangement, the platform assembly maintains almost the same angle throughout the lifting range, from the maximum lowered position to the maximum raised position. This is important so that the building materials do not fall off the platform assembly as they are raised or lowered. When the sheet is raised and near its fastening position, the sheet is self-leveled to fit flat against the fastening members. Self-leveling is accomplished by allowing limited freedom of movement of the platform assembly through an indexing arrangement.

15 Claims, 3 Drawing Sheets

LIFTING AND POSITIONING DEVICE

BACKGROUND OF THE INVENTION

This invention relates generally to a device for lifting and positioning building materials and the like. More specifically this invention relates to a lifting and positioning device in which sheets of material such as sheet rock, dry wall or plywood can be lifted and positioned for fastening to ceilings and walls, or subsequently a container of materials such as drywall joint compound for finishing the fastened sheets.

Lifting and positioning sheets of material are important to builders, handymen, and other people who fasten sheets to ceilings and walls. Installers of these sheets are constantly searching for improved methods to lift and position the sheets since the sheets are heavy and awkward to handle. This is especially important when an installer is working alone.

Several prior art lifting devices have been developed which aid in lifting sheets. However, the prior art devices use a relatively large amount of physical exertion to lift the sheet or are expensive to manufacture because they have a relatively large number of piece parts and have built-in, dedicated, actuators such as complicated pulley and rope or cable systems, threaded shafts and hydraulic actuators.

U.S. Pat. No. 4,449,879 issued on May 22, 1984 to James E. Mercer discloses a DRY WALL LIFT that requires a large amount of physical exertion since there are no mechanical or hydraulic multipliers to help lift the sheet. Also, there is no easy method to position the sheet once it is lifted, as the dry wall lift is relatively immobile. The present invention eliminates these shortcomings by providing hydraulic actuation for ease of lifting and transporting elements for mobility.

U.S. Pat. No. 4,175,899 issued on Nov. 27, 1979 to Robert R. Tipton discloses a LIFTING DEVICE that has a relatively large number of piece parts, has a built-in dedicated, hydraulic actuator and also a complicated double parallelogram mechanism for lifting and lowering the platform. The present invention eliminates these shortcomings by reducing the number of piece parts, providing a hydraulic actuator that can be easily removed and used in other applications, and a simple single parallelogram mechanism for lifting and lowering the platform.

U.S. Pat. No. 3,822,023 issued on Jul. 2, 1974 to Ted Cordel discloses a PIVOTING AND LIFTING STRUCTURE FOR SHEETING BUILDING MATERIAL that has a relatively large number of piece parts, has a dedicated threaded shaft for an actuator and also a complicated slide mechanism for raising and lowering the platform. Additionally, the platform is only horizontal at the predetermined maximum height. The present invention eliminates these shortcomings by reducing the number of piece parts, providing a hydraulic actuator that can be easily removed and used in other applications, and a simple single parallelogram mechanism for lifting and lowering the platform, and the platform can be set at any angle between vertical and horizontal and will remain relatively close to that angle during all lifting positions. This is advantageous in that if the platform is set in the horizontal position, it remains relatively horizontal during all lifting heights so the sheets do not fall off.

U.S. Pat. No. 2,789,869 issued on Apr. 23, 1957 to Joel A. Hammagren discloses a HOIST FOR CEILING MATERIAL, which is awkward since both the hoisting rope, and cable actuator must be moved in conjunction with the legs to lift the sheet. Also, there is no easy way to position the sheet once it is raised, as the hoist is relatively immobile.

The present invention eliminates these shortcomings by using a simple hydraulic actuator to lift the platform and transporting elements for mobility.

U.S. Pat No. 5,375,963 issued on Dec. 27, 1994 to Clayton E. Wohlwend discloses a MULTIPURPOSE LIFTING APPARATUS which is not designed to lift large flat sheets since it has no platform to accept large sheets and has a dedicated, built-in hydraulic actuator. The present invention eliminates these shortcomings by providing a platform to accept flat sheets and a hydraulic actuator that can be easily removed and used in other applications.

SUMMARY OF THE INVENTION

It is an object of this invention to provide a means to lift and position a sheet, container, or other load whereby the load will automatically stay at the same relative angle during lifting, from the maximum down position to the maximum up position. This is important when a load is placed in the horizontal position to avoid falling off or spilling during lifting. It is yet another object of this invention to provide a versatile, simple, inexpensive lifting and positioning device that requires no permanent, dedicated actuators. This invention allows for a number of different sizes of hydraulic actuators to be used.

It is a further object of this invention to provide a means for a sheet to self-level after the sheet is lifted close to its fastening position.

A special benefit of this invention is to a provide a simple, inexpensive, easy to manufacture lifting and positioning device, either as a finished, fully-assembled product, or as a do-it-yourself kit which any handyman can assemble himself.

These and other advantages, as will be apparent from the description herein, are provided in a lifting and positioning device comprising: a frame assembly; a lift arm assembly comprising a first side and a second side, the lift arm assembly is attached to the mast support assembly opposite to the frame assembly wherein the lift arm assembly comprises a pair of lift arms in parallel arrangement and a pair of lift arm links in parallel arrangement wherein the pair of lift arm links, pair of lift arms, and mast support assembly form a parallelogram; a mast support assembly connecting the first side of the lift arm assembly to the frame assembly; a platform assembly pivotally attached to the lift arm links; an indexing arrangement for fixing the platform assembly at any angle between horizontal and vertical (0 degrees to 90 degrees); a push link pivotally attached to the lift arm assembly; a floor jack resting on a jack support platform such that actuation of the floor jack raises and lowers the lift arm assembly; a rest assembly attached to the frame assembly upon which the lift arm assembly can rest.

DESCRIPTION OF PREFERRED EMBODIMENTS

Throughout the following description similar elements are numbered accordingly.

Figure 1:
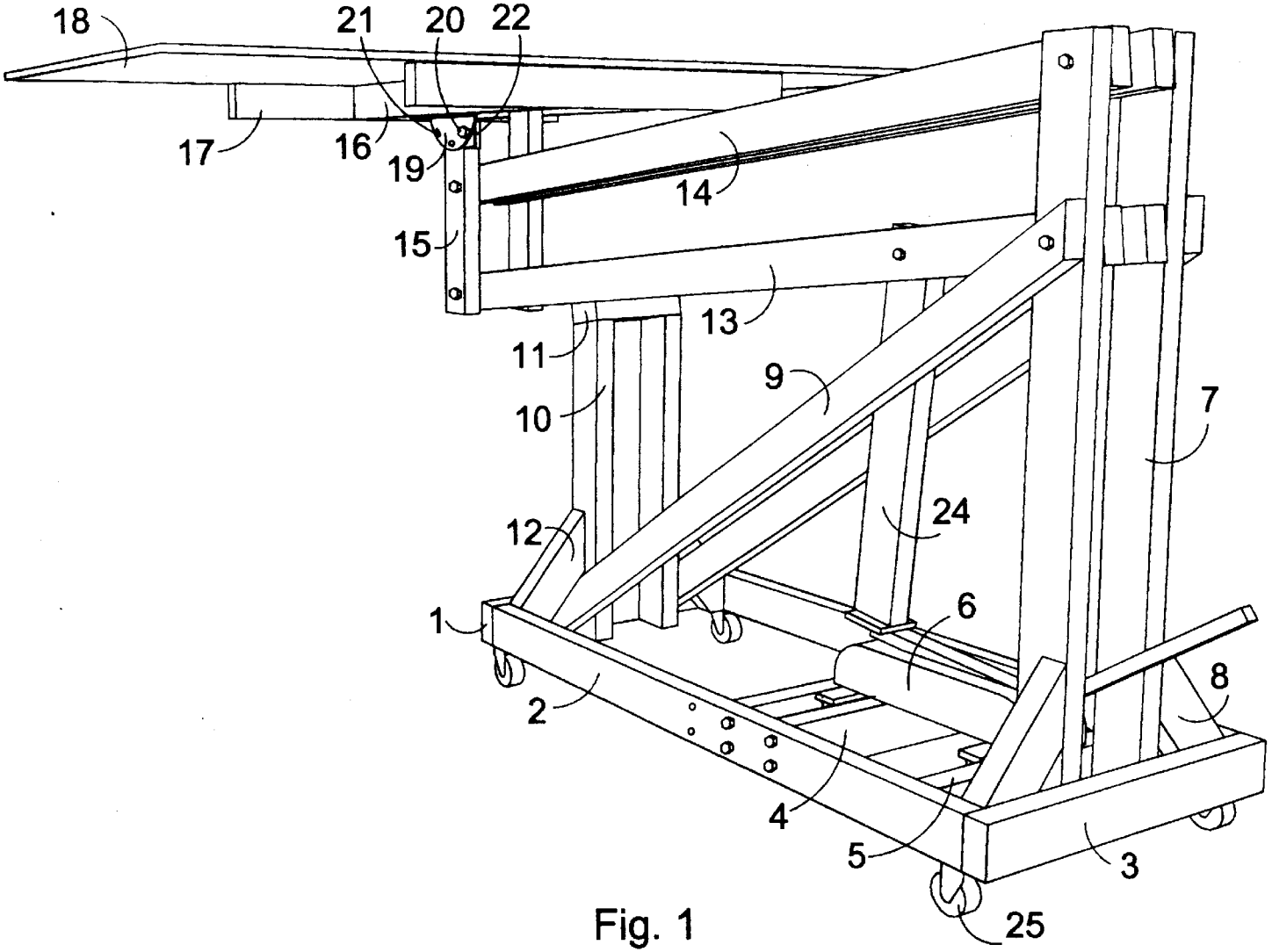
FIG. 1 shows the lifting and positioning device of the present invention in the maximum lowered position.
Figure 2:
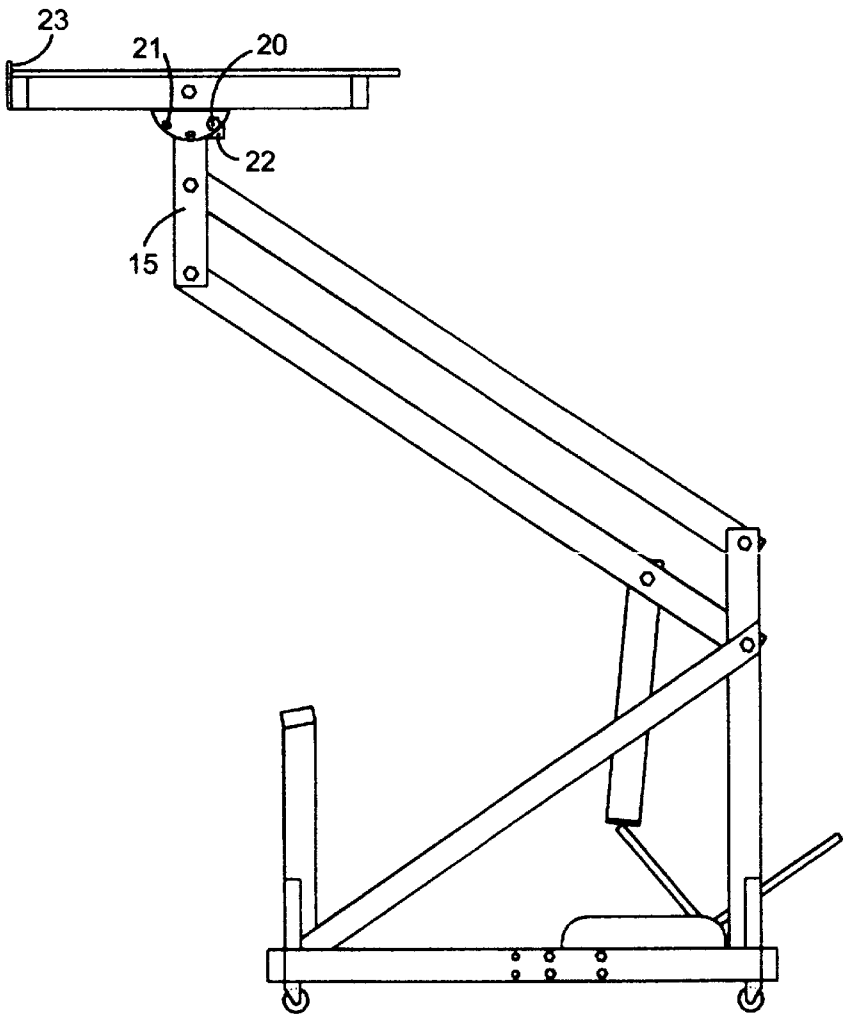
FIG. 2 shows an embodiment of the platform assembly of the present invention rotated at a 90° angle (FIG. 2C), a 45° angle (FIG. 2B) and a 0° angle
Figure 3:
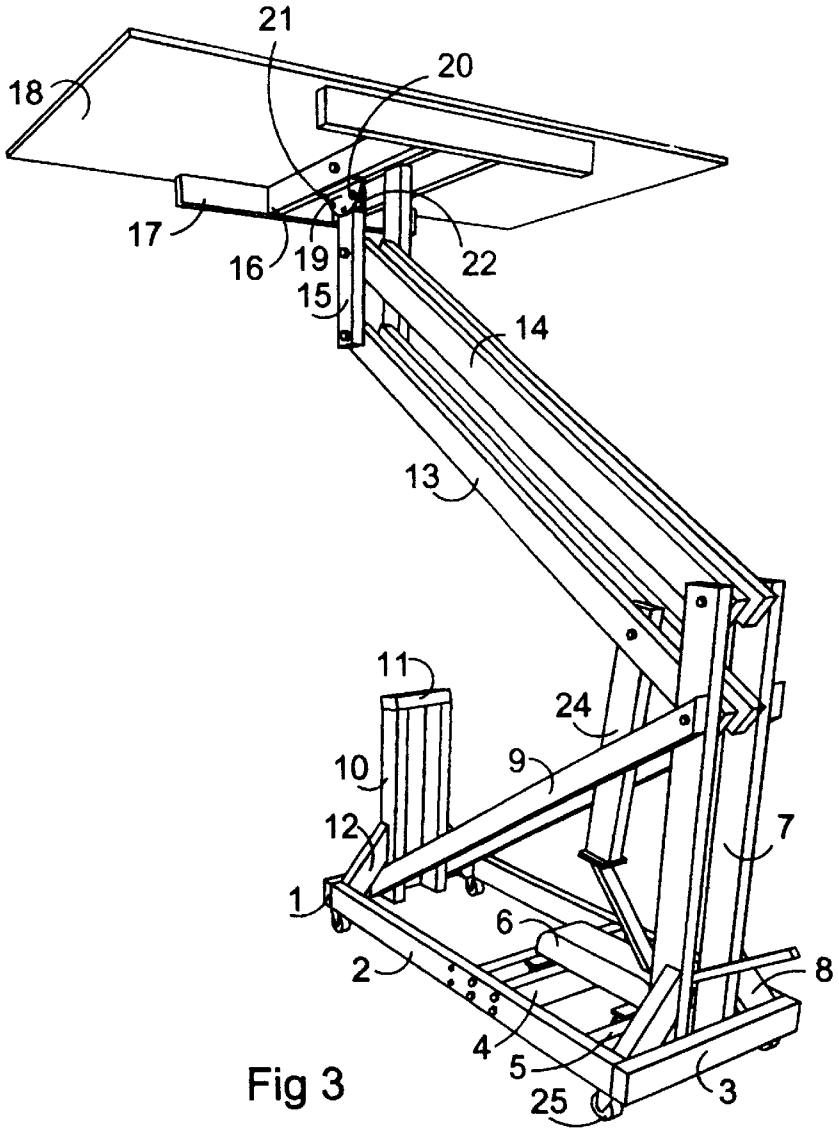
FIG. 3 shows the lifting and positioning device of the present invention in the maximum raised position.

FIG. 1 shows the lifting and positioning device of the present invention. In FIG. 1, a front member, 1, a pair of side members, 2, and a rear member, 3 define a suitable frame assembly. Attached to the side members of the frame assembly is a jack support platform for a floor jack, 6. The preferred jack support platform preferably, but optionally comprises a pair of front jack supports, 4, and a rear jack support, 5. The pair of front jack supports is adjustable to accommodate different length jacks. Attached between the rear member of the frame assembly and rear jack support is a mast support assembly to provide pivotal connecting joints for the lifting arm assembly. The mast support assembly comprises a pair of mast support members, 7. Optionally, but preferably, attached between the sides of the mast support members and side members of the frame assembly is mast side brace, 8, to provide stability for the mast support assembly. Most preferably a pair of mast side braces are used. Also, attached between the sides of the mast members and front member of the frame assembly is mast front brace, 9, to provide stability for the mast support assembly. Optionally, but preferably, a pair of mast front braces is used. Attached to the front member of the frame assembly is a rest assembly defined by a side rest member, 10, connected at the upper end by top rest member, 11. Optionally, but preferably, a pair of side rest members is used. Attached between the side members of the frame assembly and side members of the rest assembly is a rest side brace, 12, providing stability for the rest assembly. Optionally, but preferably, a pair of rest side braces is used. The rigidly fastened frame assembly, jack support platform, mast support assembly, mast side braces, mast front braces, rest assembly and rest side braces described above form a structure to support the lift arm assembly. The lift arm assembly is defined by a lower lift arm, 13, and upper lift arm, 14, both lower and upper lift arms being pivotally connected at one end to the sides of the mast support assembly and pivotally connected at the other end to a pair of lift arm links, 15. Optionally, but preferably, a pair of lower lift arms and a pair of upper lift arms are used. The lift arm links are pivotally connected to a platform assembly. The platform assembly comprises a pair of platform cross members, 16, and a pair of platform carrier members, 17. The platform assembly is used for raising and lowering building materials, 18. Attached to the bottom of platform cross member, 16, is an indexing plate, 19. The indexing plate controls the angle of the platform assembly. As the platform assembly pivots about the lift arm links an angle is formed (FIG. 2). The platform is held at this angle by inserting indexing plate fastener, 20, through a slot, 21, in the indexing plate into the indexing plate bracket, 22, which is fastened to the side of the lift arm link, 15 (FIGS. 1,2 & 3). Optionally, but preferably, indexing plate fastener and indexing plate bracket are threaded. Optionally, but preferably, there are a multiplicity of slots in the indexing plate. More preferably there are at least 3 slots, most preferably 5 slots spaced apart. When the platform is at an angle, the sheet of building material is kept from sliding off the platform by platform hooks, 23, (FIG. 2). Push link, 24, is pivotally connected at one end to the lower lift arms and the other end rests on top of the floor jack (FIG. 1). The lifting mechanism described above forms a linkage system that imparts parallel motion to the building materials placed upon the platform assembly, regardless of the platform assembly angle. The lifting and positioning device is optionally, but preferably, supported by a transporting element, 25 (FIG. 1). Preferably, the transporting element is a multiplicity of wheels. More preferably the lifting and positioning device is supported by at least 3 wheels, most preferably 4 wheels, spaced apart for stability.

Figure 2B:
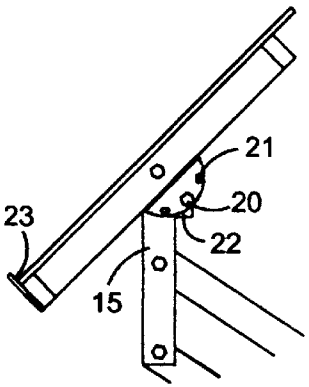
Figure 2C:
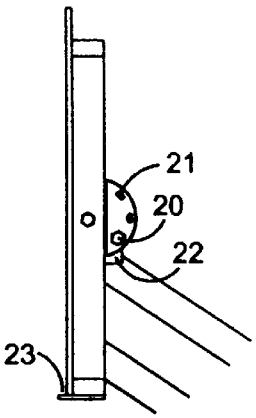

In operation, sheets of building material are placed near the area where the sheets are to be fastened. Next, a sheet is loaded upon the platform assembly. The platform assembly can be in a horizontal position or at any angle up to a vertical position (0 to 90 degrees) depending on whether the sheet is to be fastened to joists (horizontal) or to wall studs (vertical) or at another angle (FIG. 2*b*). After the sheet is loaded, the lifting and positioning device can be easily moved to where the sheet is to be fastened simply by pushing or pulling the lifting and positioning device. Once the sheet is close to the place to be fastened, the floor jack is activated and it exerts a force against the push link, which in turn exerts a force against the lift arm assembly raising the sheet (FIG. 3). It should be noted that a feature of the present invention is that most common type floor jacks may be used. This means that a dedicated floor jack is not necessary and thus the floor jack can be easily removed and used elsewhere when the lifting and positioning device is not being used. After the sheet is lifted close to its fastening position, exact positioning can be accomplished by moving the lifting and positioning device and by actuating the floor jack until the sheet is flat against the joists or wall studs. It should be noted that another feature of the present invention is that it has the capability for self-leveling a sheet. For example, when at the 0 degree (horizontal) angle, and final positioning is taking place, the sheet approaches the joists and one edge of the sheet will hit the joists first as it is not practical for every joist to be perfectly in line and perfectly level. As the edge of the sheet contacts the joist, and lifting continues, the sheet will exert a force on the platform assembly, causing the platform assembly and indexing plate to rotate about the lift arm links. Because the indexing plate is slotted, the platform assembly and indexing plate can rotate freely for approximately 5 degrees in either direction. This allows the sheet to self-level against the joists. This self-leveling characteristic is true for any angle between 0 degrees (horizontal) and 90 degrees (vertical).

I claim:

1. A lifting and positioning device comprising:

a) a frame assembly;

b) a lift arm assembly comprising a first side and a second side, wherein said lift arm assembly comprises a pair of lift arms in parallel arrangement and a pair of lift arm links in parallel arrangement wherein said pair of lift arms and said pair of lift arm links form a parallelogram;

c) a mast support assembly connecting said first side of said lift arm assembly to said frame assembly and wherein said frame assembly is attached to said mast support assembly;

d) a platform assembly pivotally attached to said lift arm links;

e) an indexing arrangement for fixing said platform assembly relative to said lift arm links;

f) a push link pivotally attached to said lift arm assembly;

g) a floor jack, such that actuation of said floor jack raises and lowers said lift arm assembly; and h) a jack support platform.

2. The lifting and positioning device of claim 1 further comprising a rest assembly attached to said frame assembly for said lift arm assembly to rest on.

3. The lifting and positioning device of claim 2 wherein said rest assembly has a height, which can increase or decrease.

4. The lifting and positioning device of claim 1 wherein said indexing arrangement comprises an indexing plate, an indexing plate bracket and an indexing plate fastener for maintaining a preselected range of angles of said platform assembly.

5. The lifting and positioning device of claim 4 wherein said indexing plate comprises a multiplicity of slotted holes allowing controlled rotation of said platform assembly relative to said indexing plate bracket.

6. The lifting and positioning device of claim 4 wherein said indexing arrangement allows said platform assembly to be self-leveling.

7. The lifting and positioning device of claim 1 wherein said jack support platform further comprises at least one front jack support and one rear jack support.

8. The lifting and positioning device of claim 7 wherein said front jack support is adjustable.

9. The lifting and positioning device of claim 1 further comprising at least three transporting elements attached to said frame assembly.

10. The lifting and positioning device of claim 1 wherein said mast support assembly further comprises a pair of mast support members that are spread apart.

11. The lifting and positioning device of claim 10 wherein said floor jack comprises an actuating handle.

12. The lifting and positioning device of claim 11 wherein the actuating handle of said jack protrudes through said mast support members.

13. The lifting and positioning device of claim 1 wherein said push link raises and lowers said lift arm assembly.

14. The lifting and positioning device of claim 13 wherein said push link can vary to increase or decrease in length.

15. The lifting and positioning device of claim 1 wherein said frame assembly has a shape chosen from a group consisting of rectangular, square and triangular.

* * * * *